United States Patent [19]

Isozumi

[11] Patent Number: 5,023,466

[45] Date of Patent: Jun. 11, 1991

[54] COAXIAL STARTER

[75] Inventor: Shuzoo Isozumi, Hyogo, Japan

[73] Assignee: Mitsubishi Denki Kabushiki Kaisha, Tokyo, Japan

[21] Appl. No.: 308,502

[22] Filed: Feb. 10, 1989

[30] Foreign Application Priority Data

Feb. 12, 1988 [JP] Japan ..... 63-31210
Feb. 12, 1988 [JP] Japan ..... 63-31211
Feb. 29, 1988 [JP] Japan ..... 63-27072[U]

[51] Int. Cl.[5] ..... F02N 11/04

[52] U.S. Cl. ..... 290/48; 290/36 R; 290/38 A; 74/7 C; 74/7 R; 310/88

[58] Field of Search ..... 290/36 R, 47, 48, 38 R, 290/38 A; 310/87, 88; 74/7 R, 7 A, 7 B, 7 C; 123/179 R, 179 M

[56] References Cited

U.S. PATENT DOCUMENTS 4,525,632 6/1985 Tanaka ..... 290/38 R
4,613,761 9/1986 Yabunaka ..... 290/36 R

FOREIGN PATENT DOCUMENTS 1311876 11/1962 France .
0394756 4/1961 Japan .
8802946 4/1988 World Int. Prop. O. ..... 290/48

*Primary Examiner*—M. H. Paschall
*Attorney, Agent, or Firm*—Sughrue, Mion, Zinn, Macpeak & Seas

[57] ABSTRACT

A coaxial starter comprising an electric motor which produces torque; a speed reduction planet gear mechanism which transmits the rotation of the armature shaft of the motor so that the rotational speed of the output portion of the mechanism is lower than that of the shaft; an overrunning clutch which transmits the output torque of the mechanism when the clutch is engaged; an output rotary shaft whose rear portion constitutes the inner member of the clutch; a pinion provided on the outside circumferential surface of the output rotary shaft so that the pinion is engaged with the ring gear of an engine as the torque of the output rotary shaft is received by the pinion; an electromagnetic switch provided around the pinion to move the pinion forward and energize the motor; and a spring provided between an actuator, which is moved forward when the switch is energized, and the pinion to push said pinion forward.

6 Claims, 3 Drawing Sheets

COAXIAL STARTER

BACKGROUND OF THE INVENTION

The present invention relates to the improvement of a starter for starting an engine, and particularly relates to the improvement of a starter for starting an engine of a motor vehicle through the action of a speed reduction planet gear mechanism.

FIG. 3 shows a conventional starter which is for starting an engine and includes a speed reduction planet gear mechanism. The armature 300 of the DC motor of the starter comprises an armature core 301, an armature shaft 302, on the halfway portion of which the armature core is provided, and a commutator 303 fitted on the armature shaft at the rear portion of the armature and connected to an armature coil 304 provided on the armature core. A holder 305 for brushes located in contact with the commutator 303 is coupled to a rear cover 307 by bolts 306. A bearing 308 for supporting the armature shaft 302 at the rear end thereof is fitted in the recess of the rear cover 307. A plurality of permanent magnets 309*a* for applying a magnetic field to the armature 300 are secured on the inside circumferential surface of the yoke 309 of the DC motor. A front cover 311 fitted with the internal gear 310 of the speed reduction planet gear mechanism is fitted to the end face of the yoke 309. A spur gear 312 is formed on the armature shaft 302 at the front end thereof. A plurality of planet gears 313 are engaged with the internal gear 310 and the spur gear 312. Bearings 314 are fitted in the planet gears 313 and supported by pins 315 secured to a flange 316 constituting the arm of the speed reduction planet gear mechanism. An output rotary shaft 317 is secured to the flange 316. A sleeve bearing 318 is fitted in the boss of the internal gear 310 and supports the output rotary shaft 317. A sleeve bearing 319 is fitted in the recess of the rear portion of the output rotary shaft 317 and supports the armature shaft 302 at the front end thereof. A steel ball 320 is provided between the ends of the armature shaft 302 and the output rotary shaft 317 to transmit a thrust. Helical splines 321 are formed on the outside circumferential surface of the halfway portion of the output rotary shaft 317. The helical splines of the outer member 322*a* of an overrunning clutch 322 comprising the outer member, an inner member 322*b* and rollers 322*c* are engaged with the helical splines 321 so that the outer member is slidable backward and forward. A stopper 323 is provided on the output rotary shaft 317 at the front end thereof to restrict the quantity of the axial movement of a pinion 324 coupled to the inner member 322*b* of the clutch 322. A sleeve bearing 325 is fitted in the anterior part of the front cover 311 and supports the output rotary shaft 317 at the front end thereof. A lever 326 is provided with a pivot 326*a* at the plastic halfway portion of the lever and fitted to the actuator 328 of an electromagnetic switch 327 and the peripheral portion of the overrunning clutch 322 at the ends of the lever. A movable contact 329 is attached with an electric insulator 330 to a rod 331 fitted in a core 332 so that the rod is slidable backward and forward. A fixed contact 333 is secured by a nut 334 to a cap 335 made of an electric insulator. An electromagnetic coil 336 for moving the actuator 328 is provided on a plastic bobbin 337 and housed in a case 338. A lead wire 339 connects the fixed contact 333 to one of the brushes. A spring 340 is housed in the actuator 328 to push the overrunning clutch 322 through the action of the lever 326. A spring 341 for returning the actuator 328 is provided further.

The operation of the conventional starter is described in detail from now on. When an ignition switch not shown in FIG. 3 is turned on, the electromagnetic coil 336 of the electromagnetic switch 327 is energized to move the actuator 328 backward to push the rod 331 to put the movable contact 329 into touch with the fixed contact 333. As a result, the armature 300 is energized through the contacts 329 and 333, the lead wire 339 and the brushes so that the armature is rotated. The rotation of the armature 300 is transmitted to the overrunning clutch 322 through the spur gear 312 and the planet gears 313 so that the speed reduction planet gear mechanism makes the rotational speed of the clutch lower than that of the armature. At that time, the pinion 324 engaged with the clutch 322 is rotated. The actuator 328 being moved backward as mentioned above swings the lever 326 counterclockwise (as to FIG. 3) about the pivot 326*a* to slide the clutch 322 together with the pinion 324 forward in the axial direction thereof to engage the pinion with a ring gear formed on the peripheral portion of a flywheel mounted on the crankshaft of the engine not shown in FIG. 3. The engine is thus started. After that, the overrunning clutch 322 is disengaged from the pinion 324 because of the rotative action of the engine to the pinion; so that the pinion races.

Since the axis of the DC motor is not coincident with that of the electromagnetic switch 327, it is necessary that the installation space for the switch is provided in a part of the engine or a vehicle. For that reason, the layout of the engine in the vehicle is restricted. This is a problem. Since the front cover 311 is open at the ring gear of the flywheel of the engine, the dust entry preventing property of the front cover is low. This is another problem. Since the overrunning clutch 322 and the pinion 324 are coupled to each other, the number of the turns of the electromagnetic coil 336 of the electromagnetic switch 327 needs to be increased to cause a high electromagnetic force to move the clutch and the pinion together with each other in the axial direction thereof. For that reason, the size and weight of the electromagnetic switch 327 are augmented. This is yet another problem. Since it is difficult due to the constitution of the starter that the distance between the ring gear of the flywheel of the engine and the surface of the starter, which is mounted on the engine, is made larger than a certain value, the design of the part of the engine, which is located near the transmission of the vehicle, is restricted. This is yet another problem. Since a certain clearance needs to be set between the mutually-engaged helical splines of the outer member 322*a* of the overrunning clutch 322 and the output rotary shaft 317 in order to make it possible to slide the outer member and the shaft backward and forward relative to each other, the outer member becomes eccentric to the inner member of the clutch. For that reason, the overrunning clutch 322 cannot always function stably. This is yet another problem.

SUMMARY OF THE INVENTION

The present invention was made in order to solve the above-mentioned problems.

Accordingly, it is an object of the present invention to provide a coaxial starter in which an electric motor and an electromagnetic switch are disposed in series with each other to make the starter compact to improve the layout of an engine. The coaxial starter comprises an electric motor; a speed reduction planet gear mechanism which transmits the rotation of the armature shaft of the motor so that the rotational speed of the output portion of the mechanism is lower than that of the armature shaft; an overrunning clutch which transmits the output torque of the planet gear mechanism when the clutch is engaged; an output rotary shaft whose rear portion constitutes the inner member of the clutch; a pinion provided on the outside circumferential surface of the output rotary shaft so that the pinion is engaged with the ring gear of the engine as the torque of the output rotary shaft is received by the pinion; an electromagnetic switch provided around the pinion to move the pinion forward and energize the motor; and a spring provided between an actuator, which is moved forward when the switch is energized, and the pinion to push the pinion forward.

It is another object of the present invention to provide a coaxial starter in which the actuator of an electromagnetic switch and a pinion are properly moved. The coaxial starter comprises an electric motor; a speed reduction planet gear mechanism which transmits the rotation of the armature shaft of the motor so that the rotational speed of the output portion of the mechanism is lower than that of the armature shaft; an overrunning clutch which transmits the output torque of the planet gear mechanism when the clutch is engaged; an output rotary shaft whose rear portion constitutes the inner member of the clutch; a pinion provided on the outside circumferential surface of the output rotary shaft so that the pinion is engaged with the ring gear of an engine as the torque of the output rotary shaft is received by the pinion; an electromagnetic switch provided around the pinion to move the pinion forward and energize the motor; and a spring provided between the actuator, which is moved forward when the switch is energized, and the pinion to push the pinion forward. The spring, a nonmagnetic holder and a plurality of nonmagnetic balls provided in the recess of the holder are disposed between the actuator and the pinion. The spring pushes the pinion through the action of the nonmagnetic holder and the nonmagnetic balls at the time of the forward movement of the actuator. The balls roll so that the spring and the actuator are not rotated even when the pinion is rotated. For that reason, the contacts of the electromagnetic switch can be surely kept in touch with each other. Since the holder and the balls are nonmagnetic, a magnetic flux does not leak into the output rotary shaft and the pinion, so that the attractive force of the switch does not weaken. For that reason, the switch and the pinion are properly moved.

It is yet another object of the present invention to provide a coaxial starter in which the electromagnetic force of an electromagnetic switch is reduced and a pinion is properly slid backward and forward on an output rotary shaft. The coaxial starter comprises an electric motor; a speed reduction planet gear mechanism which transmits the rotation of the armature shaft of the motor so that the rotational speed of the output portion of the mechanism is lower than that of the armature shaft; an overrunning clutch which transmits the output torque of the planet gear mechanism when the clutch is engaged; an output rotary shaft whose rear portion constitutes the inner member of the clutch; a pinion provided on the outside circumferential surface of the output rotary shaft so that the pinion is engaged with the ring gear of an engine as the torque of the output rotary shaft is received by the pinion; the electromagnetic switch provided around the pinion to move the pinion forward and energize the motor; and a spring provided between an actuator, which is moved forward when the switch is energized, and the pinion to push the pinion forward. Since the pinion is splineengaged with the front portion of the output rotary shaft so that the pinion is slidable backward and forward, the required electromagnetic force of the electromagnetic switch can be reduced and the pinion can be properly slid backward and forward on the output rotary shaft.

It is yet another object of the present invention to provide a coaxial starter in which a pinion is slidable backward and forward in a bearing fitted in a front cover. The coaxial starter comprises an electric motor; a speed reduction planet gear mechanism which transmits the rotation of the armature shaft of the motor so that the rotational speed of the output portion of the mechanism is lower than that of the armature shaft; an overrunning clutch which transmits the output torque of the planet gear mechanism when the clutch is engaged; an output rotary shaft whose rear portion constitutes the inner member of the clutch; a pinion provided on the outside circumferential surface of the output rotary shaft so that the pinion is engaged with the ring gear of an engine as the torque of the output rotary shaft is received by the pinion; an electromagnetic switch provided around the pinion to move the pinion forward and energize the motor; and a spring provided between an actuator, which is moved forward when the switch is energized, and the pinion to push the pinion forward. Since the coaxial starter has such an overhang that the pinion is slidable backward and forward in the bearing fitted in the front cover, the dust entry preventing property of the front cover is enhanced.

It is yet another object of the present invention to provide a coaxial starter in which the output member of an overrunning clutch is prevented from becoming eccentric, the life of the clutch is lengthened, and the armature shaft of an electric motor is supported by bearings fitted in the inner and outer members of the clutch. The coaxial starter comprises the electric motor; a speed reduction planet gear mechanism which transmits the rotation of the armature shaft of the motor so that the rotational speed of the output portion of the mechanism is lower than that of the armature shaft; an overrunning clutch which transmits the output torque of the planet gear mechanism when the clutch is engaged; an output rotary shaft whose rear portion constitutes the inner member of the clutch; a pinion provided on the outside circumferential surface of the output rotary shaft so that the pinion is engaged with the ring gear of an engine as the torque of the output rotary shaft is received by the pinion; an electromagnetic switch provided around the pinion to move the pinion forward and energize the motor; and a spring provided between an actuator, which is moved forward when the switch is energized, and the pinion to push the pinion forward. An extension of the armature shaft is inserted in both the bearing fitted in the inner member which is the rear portion of the output rotary shaft and located in front of the sun gear of the speed reduction planet gear mechanism, which is formed on the front portion of the armature shaft, and the other bearing fitted in the outer member of the overrunning clutch provided with pins which support the planet gears of the planet gear mechanism. The armature shaft is supported by the bearing fitted in the inner member of the clutch, which is formed on the output rotary shaft. The clutch is supported by the armature shaft and the bearing fitted in the outer member of the clutch. As a result, the inner and outer members of the overrunning clutch are kept coaxial with each other, the eccentricity of the outer member is prevented, the life of the clutch is lengthened, the eccentricity of the planet gears from the armature shaft and the noise of the planet gears are also prevented, the life of the planet gears is also lengthened, and the constitution of the speed reduction planet gear mechanism is stabilized.

It is yet another object of the present invention to provide a coaxial starter in which a terminal bolt, which is connected to the fixed contact of an electromagnetic switch, is attached with an electric insulator to a front cover around an overrunning clutch to prevent the design of an engine around a transmission from being restricted. The coaxial starter comprises an electric motor; a speed reduction planet gear mechanism which transmits the rotation of the armature shaft of the motor so that the rotational speed of the output portion of the mechanism is lower than that of the armature shaft; the overrunning clutch which transmits the output torque of the planet gear mechanism when the clutch is engaged; an output rotary shaft whose rear portion constitutes the inner member of the clutch; a pinion provided on the outside circumferential surface of the output rotary shaft so that the pinion is engaged with the ring gear of the engine as the torque of the output rotary shaft is received by the pinion; an electromagnetic switch provided around the pinion to move the pinion forward and energize the motor; and a spring provided between an actuator, which is moved forward when the switch is energized, and the pinion to push the pinion forward. Since the terminal bolt is attached as described above, a surface for mounting the coaxial starter in an engine room can be provided in an optional position in front of the terminal bolt to increase the degree of freedom of the design of the engine around the transmission.

DETAILED DESCRIPTION OF THE PREFERRED EMBODIMENTS

Embodiments of the present invention are hereafter described in detail with reference to the drawings attached hereto.

Figure 1:
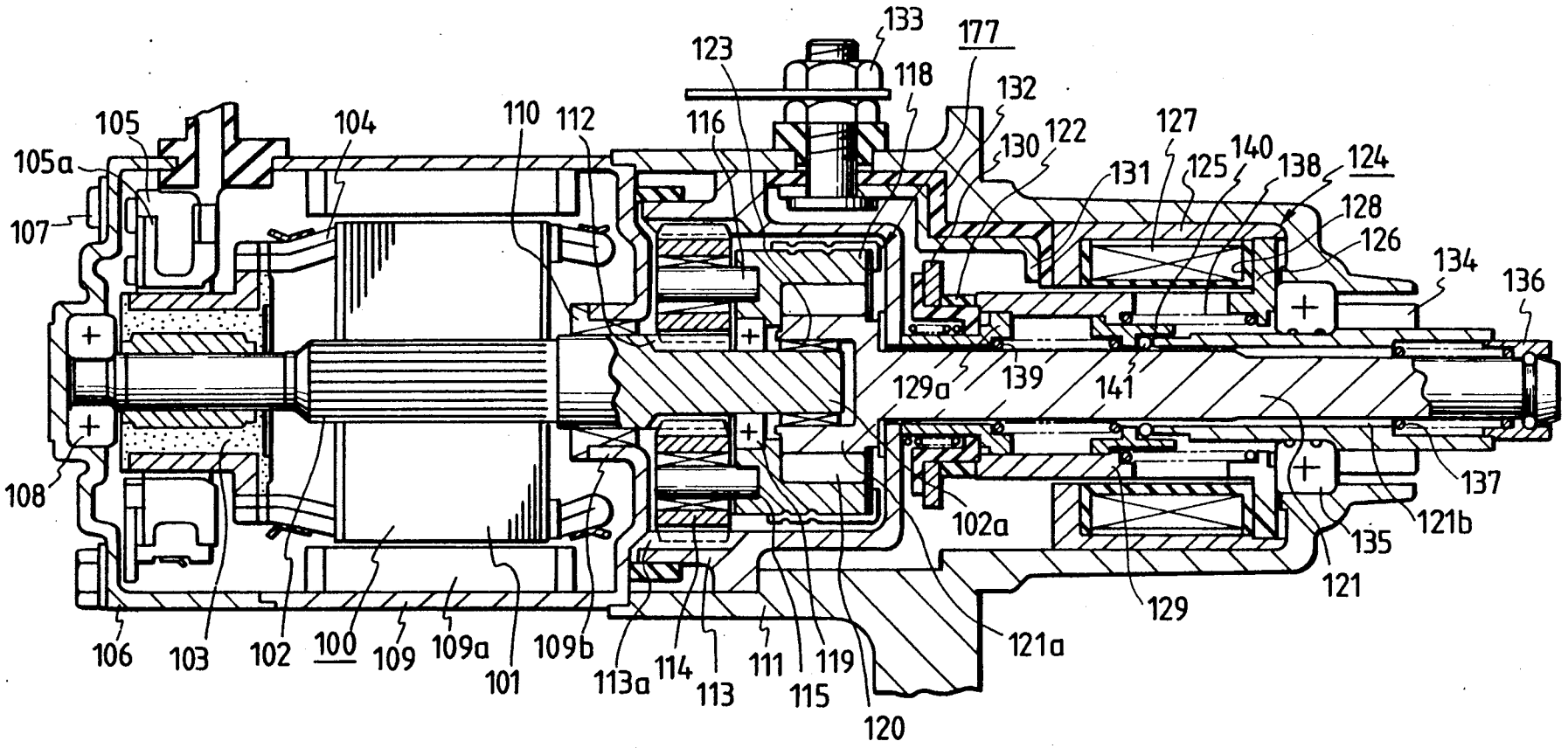
FIG. 1 shows a longitudinally sectional view of a coaxial starter which is an embodiment of the present invention.

FIG. 1 shows a coaxial starter which is one of the embodiments. The coaxial starter includes a DC motor having an armature 100 comprising an armature core 101, an armature shaft 102, a commutator 103 and an armature coil 104. Brushes 105 are provided in sliding contact with the commutator 103. A holder **105*a* holding the brushes 105 is coupled by bolts 107 to a rear cover 106 covering the rear portion of the armature 100. A bearing 108 is fitted in the recess of the rear cover 106 and supports the armature shaft 102 at the rear end thereof. A permanent magnet 109*a* for applying a magnetic field to the armature 100 is secured to the inside circumferential surface of the yoke 109 of the DC motor. The front central portion 109*b* of the yoke 109 is cylindrically bent. A bearing 110 is fitted in the front central portion 109*b* of the yoke 109 and supports the armature shaft 102 at the front portion thereof. A spur gear 112 is formed as a sun gear on the armature shaft 102 in front of the bearing 110. A plurality of planet gears 114 are engaged with the spur gear 112 and an internal gear 113*a* formed on the inside circumferential surface of an internal gear constitutor 113 shaped as a bowl and fitted in a front cover 111 attached to the front of the yoke 109. Bearings 115 are fitted in the planet gears 114 and supported by pins 116**.

The coaxial starter also includes an overrunning clutch 117. The pins 116 are secured to the outer member 118 of the clutch 117. The outer member 118 is formed with a wedge-like cam. A bearing 119 is fitted in the rear recess of the outer member 118 and supports the armature shaft 102 fitted in the bearing at the portion **102*a* of the armature shaft in front of the spur gear 112 to prevent the outer member from becoming eccentric. The clutch 117 has rollers 120** for the transmission of torque.

The coaxial starter also includes an output rotary shaft 121 coaxial with the armature shaft 102 and having a rear portion **121*a* constituting the inner member of the clutch 117. A bearing 122 is fitted in the recess of the inner member 121*a* of the clutch 117 and supports the armature shaft 102 having the front portion 102*a* fitted in the bearing in front of the other bearing 119. The front portion of the internal gear constitutor 113 is shaped so as to cover the overrunning clutch 117 and is located on a washer 123 on the front end of the rear portion 121*a* of the output rotary shaft 121 to prevent the shaft from moving in the axial direction thereof and receive a thrust. The front portion of the internal gear constitutor 113 keeps grease from flying away from a speed reduction planet gear mechanism which transmits the torque of the armature shaft 102 to the output rotary shaft 121 so that the rotational speed of the output rotary shaft is lower than that of the armature shaft. The output rotary shaft 121 extends forward through the hole of the front central portion of the internal gear constitutor 113**.

The starter also includes an electromagnetic switch 124 provided around the output rotary shaft 121. The switch 124 comprises a nearly cylindrical case 125 having a constricted opening at the rear end of the case and fitted in the front part of the halfway portion of the front cover 111; a nearly annular core 126 fitted in the front recess of the case; a plastic bobbin 128 provided with an electromagnetic coil 127 and housed in the case; a cylindrical actuator 129 movable through the hole of the bobbin in the axial direction of the switch and secured at the rear portion of the actuator to a holder **129*a* movable on the output rotary shaft but usually remaining stopped with the rear end of the holder in contact with the front of the internal gear constitutor 113; a movable contact 130 attached with an electric insulator to the holder and having a face extending perpendicularly to the axis of the switch; and a fixed contact 131 facing the movable contact forward, bent along the form of the inside surface of the front cover and attached with an electric insulator 132 to the front cover around behind the overrunning clutch 117 by a terminal bolt 133 connected to a terminal connected to a battery not shown in FIG. 1. Another terminal bolt not shown in FIG. 1 is connected to one of the brushes 105** through a lead wire.

The helical splines of the inner portion of a pinion 134 are engaged with those 121*b* of the front outer portion of the output rotary shaft 121 so that the pinion is slidable backward and forward and that the pinion is engaged with the ring gear of an engine (not shown in the drawing) when the coaxial starter is put in action. The untoothed portion of the pinion 134 slides on the inside circumferential surface of a bearing 135 fitted in the front cover 111 in front of the electromagnetic switch 124. The teeth of the pinion 134 are located in front of the bearing 135 so that the pinion is stopped when the teeth thereof come into contact with the front end of the bearing. The front end of the front cover 111 surrounds the teeth of the pinion 134. A stopper 136 is attached to the output rotary shaft 121 at the front end thereof so that the rear end of the stopper is opposed to the inside stepped surface of the pinion 134 backward to restrict the length of the movement of the pinion. A pinion return spring 137 is provided between the stopper 136 and the pinion 134. An actuator return spring 138 is provided between the actuator 129 and the core 126. A pressure spring 139 is provided between the holder 129*a* and a nonmagnetic holder 140 to push the pinion 134 at the rear end thereof through the action of the nonmagnetic holder and a plurality of nonmagnetic balls 141. It is preferable that the pressure spring 139 is made of a nonmagnetic material. The holder 140 has a front and a rear axial recesses through which the output rotary shaft 121 extends. The balls 141 are located in the front axial recess 140*a* of the holder 140 between the output rotary shaft 121 and the holder. The front end of the pressure spring 139 is located in the rear axial recess of the holder 140. The holder 140 and the actuator 129 are engaged with each other when they are moved backward and forward.

The operation of the starter is described in detail from now on. When an ignition switch not shown in FIG. 1 is turned on the electromagnetic coil 127 of the electromagnetic switch 124 is energized to move the actuator 129 forward so that the movable contact 130 attached to the holder 129*a* secured to the actuator comes into touch with the fixed contact 131. As a result, the armature 100 of the DC motor is energized through the contacts 130 and 131, the lead wire and the brushes 105 so that the armature is rotated. The torque of the armature 100 is transmitted to the output rotary shaft 121 through the speed reduction planet gear mechanism including the sun gear 112 and the planet gears 114, and the overrunning clutch 117. The torque of the output rotary shaft 121 is transmitted to the pinion 134 through the helical splines 121*b*. Since the actuator 129 is moved forward, the pinion 134 is moved forward through the action of the holder 129*a*, the pressure spring 139, the holder 140 and the balls 141 so that the pinion is engaged with the ring gear formed on the peripheral portion of the flywheel of the engine.

When the ignition switch is turned off, the actuator 129 is moved backward by the restoring force of the actuator return spring 138 and the pinion 134 is moved backward to the original position (shown in FIG. 1) thereof away from the ring gear of the engine by the pinion return spring 137. At that time, the movable contact 130 is separated from the fixed contact 131 to de-energize the armature 100 of the DC motor to stop the rotation thereof.

Figure 2:
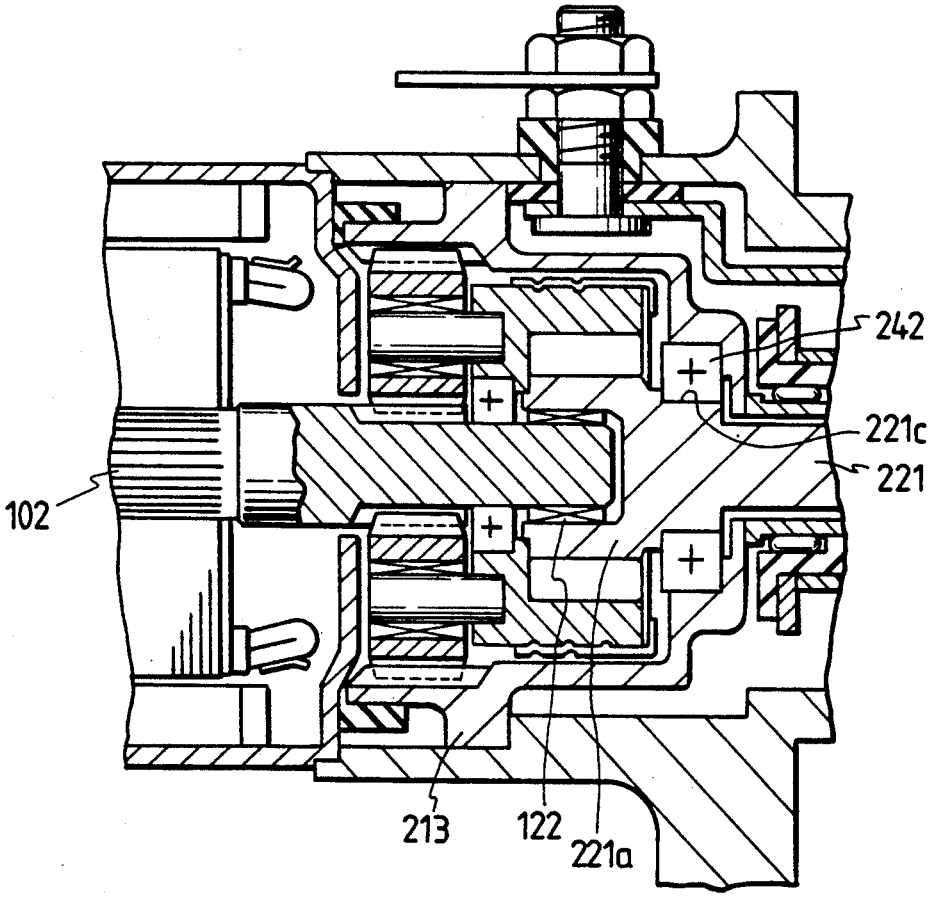
FIG. 2 shows a longitudinally sectional view of a major part of a coaxial starter which is another embodiment of the present invention.
Figure 3:
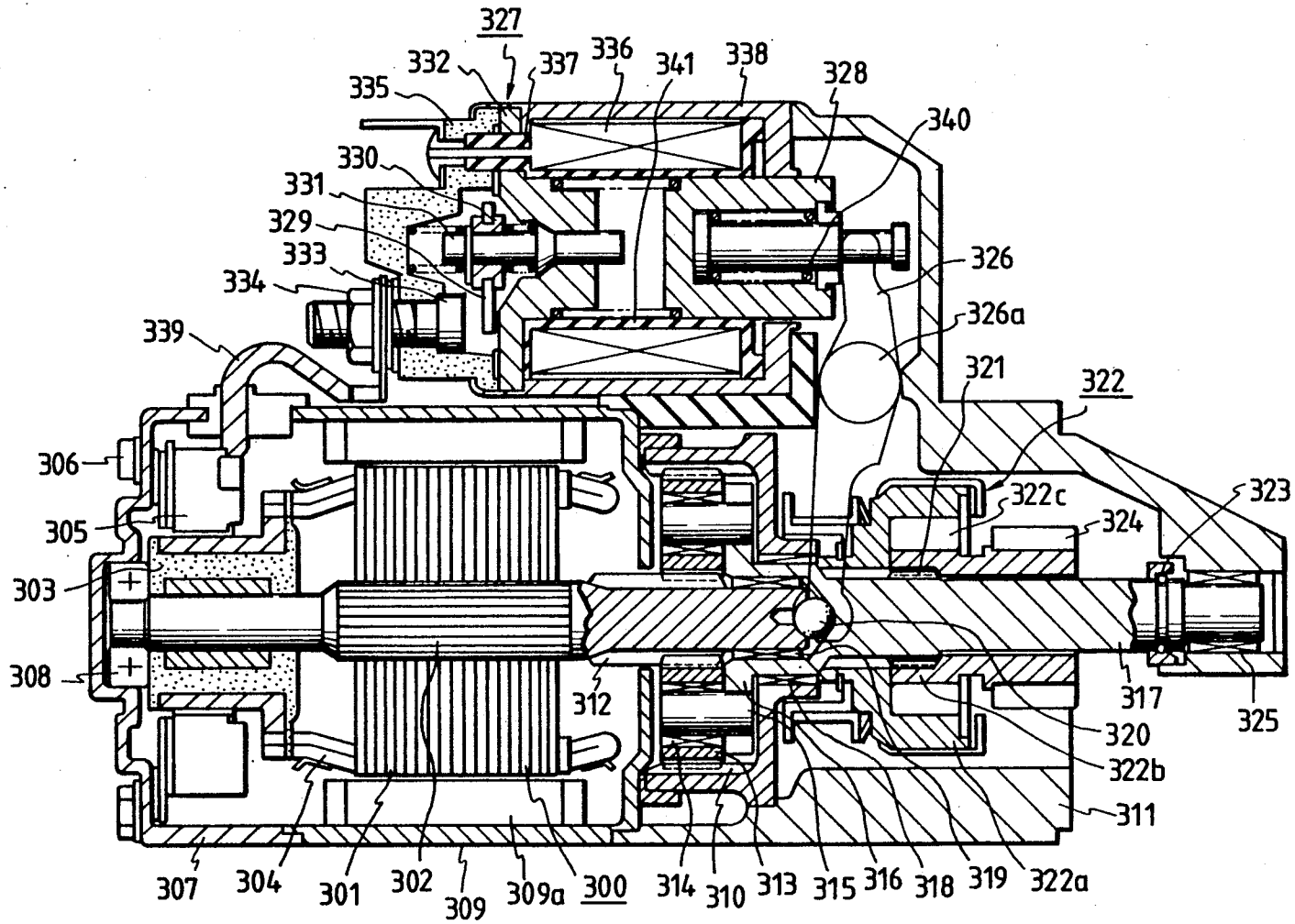
FIG. 3 shows a longitudinally sectional view of a conventional starter.

Although the rear portion 121*a* (which is the inner member of the overrunning clutch 117) of the output rotary shaft 121 is supported on the bearing 122 on the armature shaft 102 in the above-described embodiment, the present invention may be otherwise embodied so that a bearing 242 mounted on the outside circumferential surface of the stepped portion 221*c* of an output rotary shaft 221, which is located immediately in front of the rear portion 221*a* (which is the inner member of an overrunning clutch) of the shaft, is fitted in the front recess of an internal gear constitutor to support an armature shaft 102 in cooperation with a bearing 122 fitted in the rear portion 221*a* of the output rotary shaft, as shown in FIG. 2.

Although the commutator 303 is provided on the rear portion of the armature 100 in the above-described embodiment, the present invention may be otherwise embodied so that the commutator is provided on the front portion of the armature and the brushes 105 are attached between the core of the armature and the speed reduction planet gear mechanism to diminish the length of the lead wire.

Although the planet gears 114 are supported by the pins 116 secured to the outer member 118 of the overrunning clutch 117 in the above-described embodiment, the present invention may be otherwise embodied so that the outer member of the clutch is provided with projections for supporting the planet gears fitted with the bearings 115.

Although the permanent magnet 109*a* is provided to apply the magnetic field to the armature 100 in the above-described embodiment, the present invention may be otherwise embodied so that electromagnetic coils are provided around iron poles to apply a magnetic field to the armature.

Although the nonmagnetic balls 141 are provided in the recess of the nonmagnetic holder 140 in the above-described embodiment, the present invention may be otherwise embodied as far as the balls are made unable to move up or roll out of position.

As far as a pressure spring, a nonmagnetic holder and nonmagnetic balls are provided between an actuator and a pinion in a coaxial starter, it produces the same effect as the above-described coaxial starter even if the former does not have a speed reduction planet gear mechanism.

What is claimed is:

1. A coaxial starter for an engine having a ring gear comprising:

an electric motor, having an armature shaft defining an axis of rotation, which produces torque;

a speed reduction planet gear mechanism which connects the rotation of said armature shaft of said motor about said axis at a first speed into a rotation of an output portion of said mechanism about said axis at a second speed lower than said first speed;

an overrunning clutch which transmits the output torque of said mechanism when said clutch is engaged;

an output rotary shaft rotatable about said axis of rotation, and comprising a front and a rear portion, said rear portion comprising an inner member of said clutch;

a pinion provided on the outside circumferential surface of said front portion of said output rotary shaft so that said pinion is engaged with said ring gear of an engine as the torque of said output rotary shaft is received by said pinion;

an electromagnetic switch provided around said pinion to move said pinion forward and engage said ring gear of said motor;

an actuator, movable to connect a source of power to said motor when said switch is energized; and a spring provided between said actuator and said pinion and biased to push said pinion forward.

2. A coaxial starter according to the claim 1, wherein a nonmagnetic holder and a plurality of nonmagnetic balls are provided between the spring and the pinion; and said balls are located in the recess of said holder.

3. A coaxial starter according to the claim 1, wherein the pinion is spline-engaged with the front portion of the output rotary shaft so that said pinion is slidable backward and forward.

4. A coaxial starter according to the claim 1, which has such an overhang that the pinion is slidable backward and forward in a bearing fitted in a front cover.

5. A coaxial starter according to the claim 1, wherein an extension of the armature shaft is inserted in both a bearing fitted in the inner member of the overrunning clutch in front of the sun gear of the speed reduction planet gear mechanism, which is formed on the front portion of said shaft, and a bearing fitted in the outer member of said clutch provided with pins which support the planet gears of said mechanism.

6. A coaxial starter according to the claim 1, wherein a terminal bolt is attached with an electric insulator to a front cover around the overrunning clutch and connected to the fixed contact of the electromagnetic switch.

* * * * *